US006986424B1

(12) United States Patent
Morrison

(10) Patent No.: US 6,986,424 B1
(45) Date of Patent: Jan. 17, 2006

(54) PACKAGE/CONTAINER FOR BATTERIES

(76) Inventor: David J. Morrison, 3338 Rutledge Dr., Las Vegas, NV (US) 89120

( * ) Notice: Subject to any disclaimer, the term of this patent is extended or adjusted under 35 U.S.C. 154(b) by 0 days.

(21) Appl. No.: 11/080,813

(22) Filed: Mar. 16, 2005

Related U.S. Application Data

(63) Continuation-in-part of application No. 10/981,648, filed on Nov. 5, 2004.

(51) Int. Cl.
*B65D 85/00* (2006.01)

(52) U.S. Cl. ..... 206/703; 206/469

(58) Field of Classification Search ..... 206/462, 206/469, 470, 473, 703, 705, 775, 779, 461
See application file for complete search history.

(56) References Cited

U.S. PATENT DOCUMENTS

| | | | | |
|---|---|---|---|---|
| 1,389,984 | A | | 9/1921 | Reed |
| 1,587,356 | A | | 6/1926 | Riebeth |
| 1,655,881 | A | | 1/1928 | Steeves |
| D156,729 | S | | 1/1950 | Hampe et al. |
| 2,616,751 | A | | 11/1952 | Goldenberg |
| 3,692,175 | A | * | 9/1972 | Hordler ..... 206/470 |
| 3,946,877 | A | | 3/1976 | Galicia |
| 4,106,621 | A | * | 8/1978 | Sorenson ..... 206/365 |
| 4,130,200 | A | | 12/1978 | Iepson et al. |
| D252,429 | S | | 7/1979 | Morin |
| 4,205,620 | A | | 6/1980 | Keys |
| D262,337 | S | | 12/1981 | Bateman et al. |
| D273,162 | S | | 3/1984 | Halverson |
| 4,637,580 | A | | 1/1987 | Idstein |
| 4,696,402 | A | | 9/1987 | Harmon et al. |
| 4,702,975 | A | | 10/1987 | Fields |
| 5,117,976 | A | | 6/1992 | Whitt et al. |
| 5,154,293 | A | * | 10/1992 | Gould ..... 206/461 |
| 5,209,354 | A | | 5/1993 | Thornhill et al. |
| 5,544,755 | A | | 8/1996 | Paumen et al. |
| 5,579,928 | A | | 12/1996 | Anukwuem |
| 5,655,673 | A | | 8/1997 | Weterrings et al. |
| 5,735,404 | A | | 4/1998 | Kumakura et al. |
| 5,871,100 | A | | 2/1999 | Ward |
| 5,947,297 | A | | 9/1999 | Aoki et al. |
| D424,933 | S | | 5/2000 | Albright et al. |
| D425,417 | S | | 5/2000 | Gaffney et al. |
| 6,071,583 | A | | 6/2000 | Pomerantz |
| 6,119,864 | A | | 9/2000 | Kessler et al. |
| 6,164,490 | A | | 12/2000 | Bishop et al. |
| 6,244,444 | B1 | | 6/2001 | Jacobus et al. |

(Continued)

FOREIGN PATENT DOCUMENTS

| | | |
|---|---|---|
| JP | 10-165269 | 6/1998 |
| JP | 2002-2769 | 1/2002 |

*Primary Examiner*—Shian T. Luong
(74) *Attorney, Agent, or Firm*—Richard C. Litman

(57) ABSTRACT

The storage and display package for batteries is a blister pack that can be secured in a vertical position on cabinet doors, sheds and RV walls. The package allows the user to access individual batteries from the front or top of the package, while the package is secured in such locations. The package may have a perforated, removable top section or a re-closeable flap on the front of the package. The package may alternatively include a clip that may be removed from the package and secured in the stated locations with the batteries held in the clip. The package may additionally include a reservoir formed in the front of the package that is adapted to receive the base ends of electric toothbrushes, in order to store the electric toothbrushes near the batteries.

2 Claims, 15 Drawing Sheets

U.S. PATENT DOCUMENTS

| | | | |
|---|---|---|---|
| 6,308,832 | B1 | 10/2001 | Pirro et al. |
| 6,382,420 | B1 | 5/2002 | Bouthiette |
| 6,427,841 | B2 | 8/2002 | Wani et al. |
| 6,439,390 | B1 | 8/2002 | Kumakura et al. |
| 6,478,158 | B2 | 11/2002 | Gaffney et al. |
| D486,010 | S | 2/2004 | Scola |
| 6,736,267 | B2 | 5/2004 | Schamante |
| 2001/0052478 | A1 | 12/2001 | Casanova et al. |
| 2004/0020883 | A1 | 2/2004 | Brokaw |
| 2004/0112790 | A1 | 6/2004 | Lee et al. |
| 2004/0182802 | A1 | 9/2004 | Paul |

* cited by examiner

PACKAGE/CONTAINER FOR BATTERIES

CROSS-REFERENCE TO RELATED APPLICATIONS

This is a continuation-in-part of my prior application Ser. No. 10/981,648, filed Nov. 5, 2004.

BACKGROUND OF THE INVENTION

1. Field of the Invention

The present invention relates to packaging. More specifically, the invention relates to packaging for sale, display and storage of small household items such as batteries.

2. Description of the Related Art

Batteries have, for many years, been sold in packaging conventionally known as "blister packs". These packs include a clear plastic covering over the batteries, which allow the batteries to be seen by the potential customer. Often, batteries are sold in large quantities within the same blister pack. While this packaging is quite helpful in promoting the batteries before sale, it is not entirely useful once the consumer gets the batteries home.

With conventional blister packs, the consumer often would open the blister pack to use one or two batteries, then would leave the remaining unused batteries lying loose in the "junk drawer". Improvements in the blister packs have allowed the consumer to access only the number of batteries needed, then store the remaining unused batteries in the blister pack until needed. However, these packs are still being left in the "junk drawer" or otherwise packed away until a later need.

Most devices that use batteries are not generally used or stored in the same location the batteries are stored in. There is therefore a need for battery packaging that retains the before-sale advantages of conventional blister packs, while allowing the batteries to be stored in a protective pack that can be kept in an easily accessible location near where the consumer would typically need the batteries. There is also a need for packaging that allows the consumer access to the individual batteries while the package is stored in such a location.

SUMMARY OF THE INVENTION

The storage and display package for batteries is a blister pack that can be removably secured in a vertical position on cabinet doors, sheds and RV walls. The package allows the user to access individual batteries from the front or top of the package, while the package is secured in such locations. The package may have a perforated, removable top section or a re-closeable flap on the front of the package. The package may alternatively include a clip that may be removed from the package and secured in the stated locations with the batteries held in the clip.

Using a blister pack design, the package includes a display card that may have indicia printed on it. The display card may include a hole to allow the package to be hung from a hook or peg while on display before sale. A thermoplastic or other clear protective container is secured to the display card. In the case of a thermoplastic container, a heat seal is used around the edges of the container to affix the container to the display card. The container may take any shape that may reasonably hold the product contained within it, but recent conventional blister packs are generally rectangular in shape with indents formed in the thermoplastic to conform the container to the shape of the batteries and better hold the batteries in place.

The package has at least one adhesive strip affixed to the back of the display card. The shape and size of the adhesive strip may vary, so long as the strip can support a full battery pack when secured to a vertical surface.

In the first described embodiment of the packaging, the display card and thermoplastic container have perforations running across the package. These perforations allow the package to be torn open in such a manner as to create an open topped container. The adhesive strip is affixed to the back of the display card below the perforations, so that when the packaging is opened, the open package may still be secured to the cabinet door, shed wall, RV walls or any other vertical surfaces near where batteries may be needed. The individual batteries may be removed from the open package as needed, leaving the unused batteries in an organized, easily accessible location.

In an alternative embodiment, the perforations may only run down from the top edge of the container to a pre-formed crease that runs across the front of the container. A small tab is formed in the display card by a series of perforations. The tab is secured to the top edge of the container using a heat seal. The remainder of the top edge of the container is not sealed to the display card. The tab may be torn from the display card, and the top section of the thermoplastic container may then be pulled forward, folding over the pre-formed crease. This allows the batteries to be removed from the package while retaining the integrity of the remainder of the container so that it may still be used to store batteries. The individual batteries may be removed from the open package as needed, leaving the unused batteries in an organized, easily accessible location.

In a third embodiment of the packaging, a clip with a base and a number of gripping arms holds each of the individual batteries and is held within the thermoplastic container. The clip has a small ledge on the bottom of its base that helps to support the batteries as they are held between the gripping arms. The clip also has an adhesive strip affixed to the back of the base. When the packaging is opened and the clip is removed, the clip may be secured to a vertical surface, with the unused batteries still held within the gripping arms of the clip. Other small household items, such as pill bottles and other toiletries, may also be held in the clip. Again, the individual batteries may be removed from the clip as needed, leaving the unused batteries in an organized, easily accessible location.

In a fourth embodiment, the blister packaging may be extended at the lower end to allow a reservoir to be formed into the thermoplastic container. The reservoir is defined by a recess formed in the top surface of the battery-accommodating portion. The reservoir is adapted to receive the base end of at least one electric toothbrush, in order to store the toothbrush near the batteries. Any water and toothpaste residue that may slide off of the toothbrush will be collected in the reservoir.

In a fifth embodiment, the battery packaging may use a standard clam shell design with a reservoir formed in the battery accommodating portion of the clam shell packaging. The clam shell packaging includes at least one battery-accommodating portion and an opening in the battery-accommodating portion for allowing the user to access the batteries. A sealing edge surrounds the opening on the battery-accommodating portion, the sealing edge having a top end, a bottom end, and two sides. A lid is pivotally connected to the top end of the sealing edge. The lid may mateably engage the sealing edge to close the opening in the battery-accommodating portion of the packaging. The lid may also be pivoted open to allow the user to access the batteries through the opening.

The reservoir in the clamshell packaging is defined by a recess formed in the top surface of the battery accommodating portion. The reservoir is adapted to receive the base end of at least one electric toothbrush, in order to store the toothbrush near the batteries. Any water and toothpaste residue that may slide off of the toothbrush will be collected in the reservoir.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
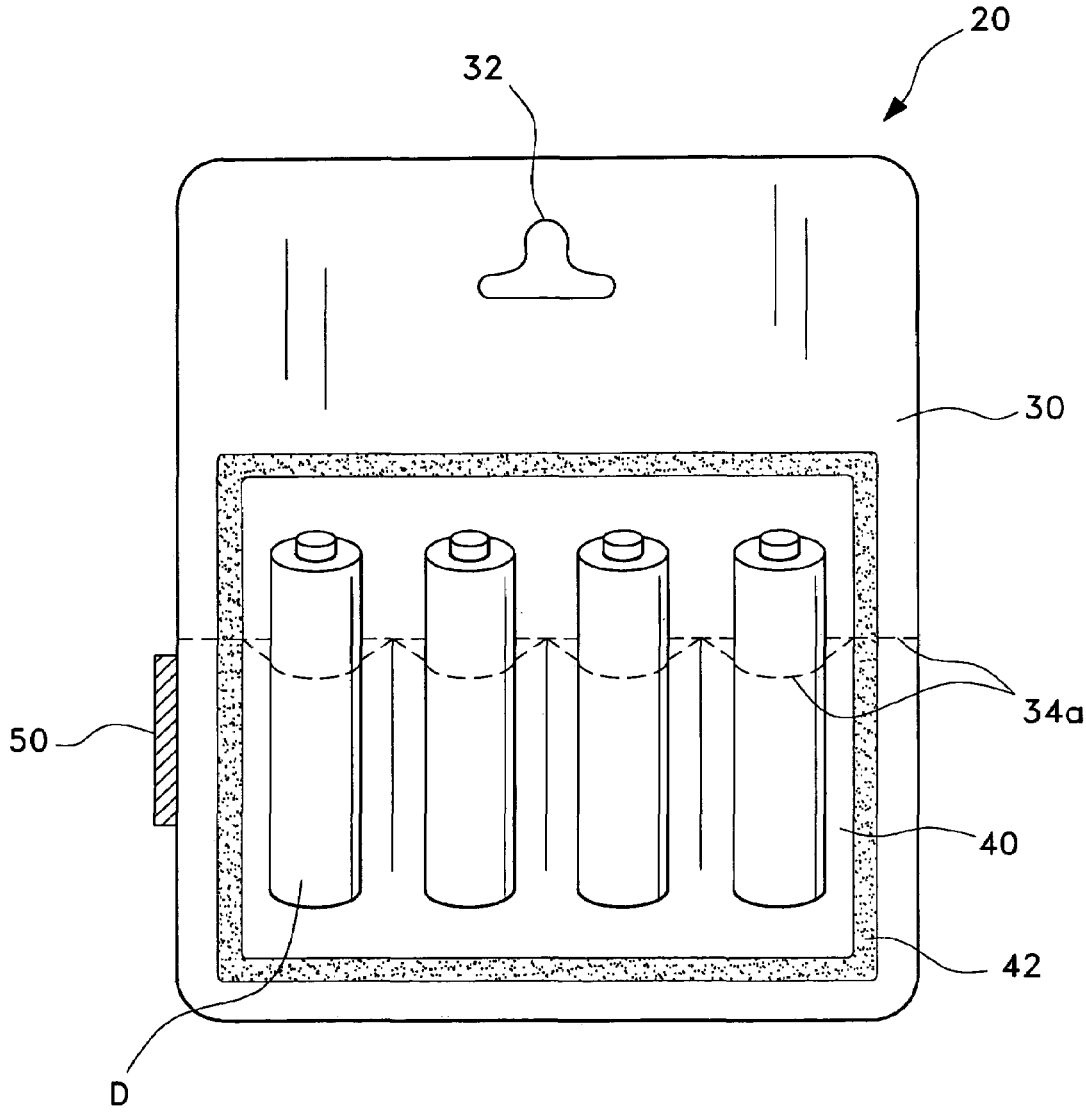
FIG. 1 is a perspective view of a battery package with perforations as shown and described in present invention.

The present invention is a storage and display package for batteries, designated generally in the drawings as 20. The package 20 can be removably secured in a vertical position on cabinet doors, sheds and RV walls. The package 20 allows the user to access individual batteries D from the front or top of the package 20, while the package 20 is secured in such locations.

Figure 3:
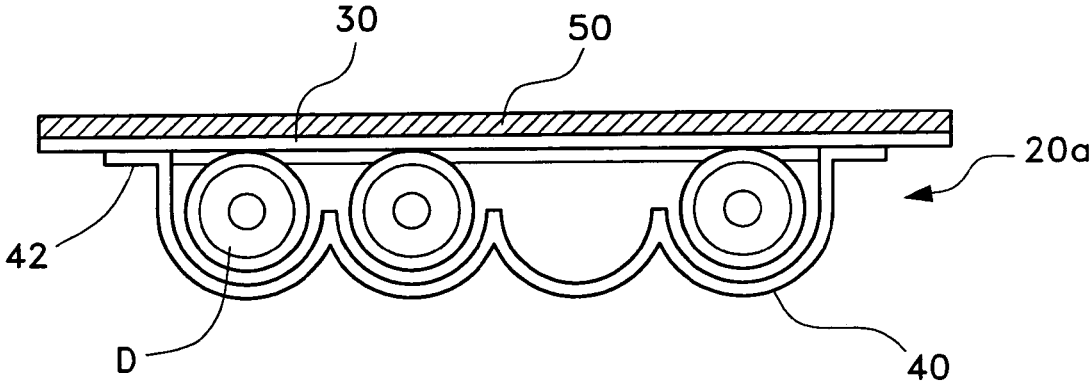
FIG. 3 is a top view of an opened battery package for four batteries as shown and described in present invention.
Figure 4:
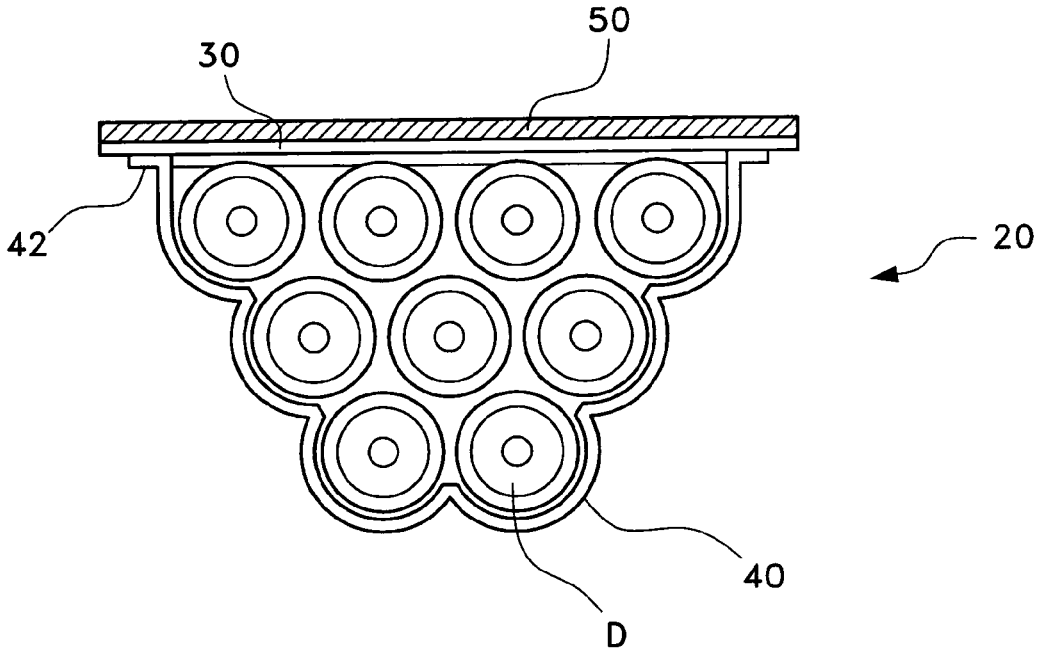
FIG. 4 is a top view of an opened battery package for more than four batteries as shown and described in present invention.
Figure 5:
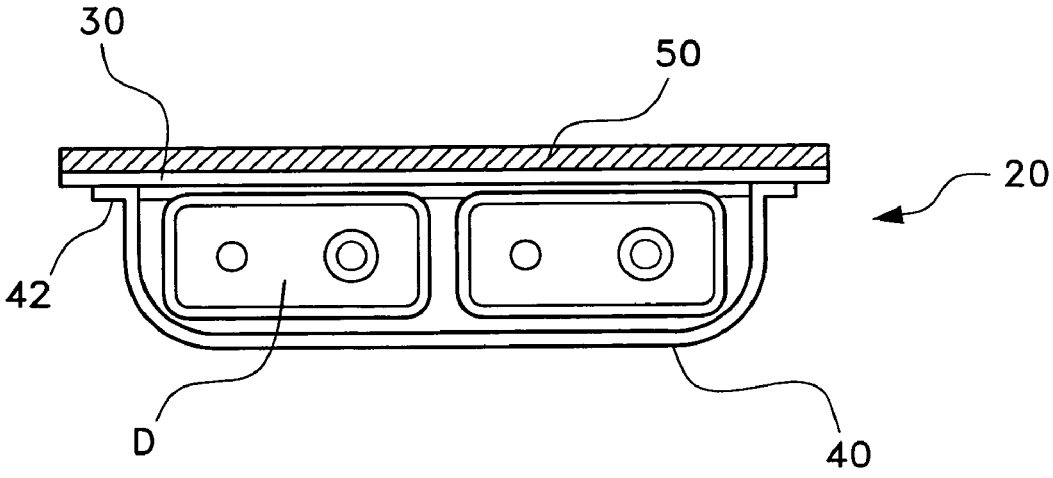
FIG. 5 is a top view of an opened battery package for rectangular batteries as shown and described in present invention.

Using a conventional blister pack design, the package 20 includes a display card 30 that may have indicia printed on it. As shown in FIG. 1, the display card 30 may include a hole 32 to allow the package 20 to be hung from a hook or peg while on display before sale. A thermoplastic or other clear protective container 40 is secured to the display card 30. In the case of a thermoplastic container, a heat seal 42 is used around the edges of the container 40 to affix the container 40 to the display card 30. The container 40 may take any shape that may reasonably hold the product contained within it, as shown in FIGS. 3–5, but recent conventional blister packs are generally rectangular in shape with indents formed in the thermoplastic to conform the container to the shape of the batteries and better hold the batteries in place.

The package 20 has at least one adhesive strip 50 affixed to the back of the display card 30. The shape and size of the adhesive strip 50 may vary, so long as the strip 50 can support a full battery pack 20 when secured to a vertical surface.

Figure 2:
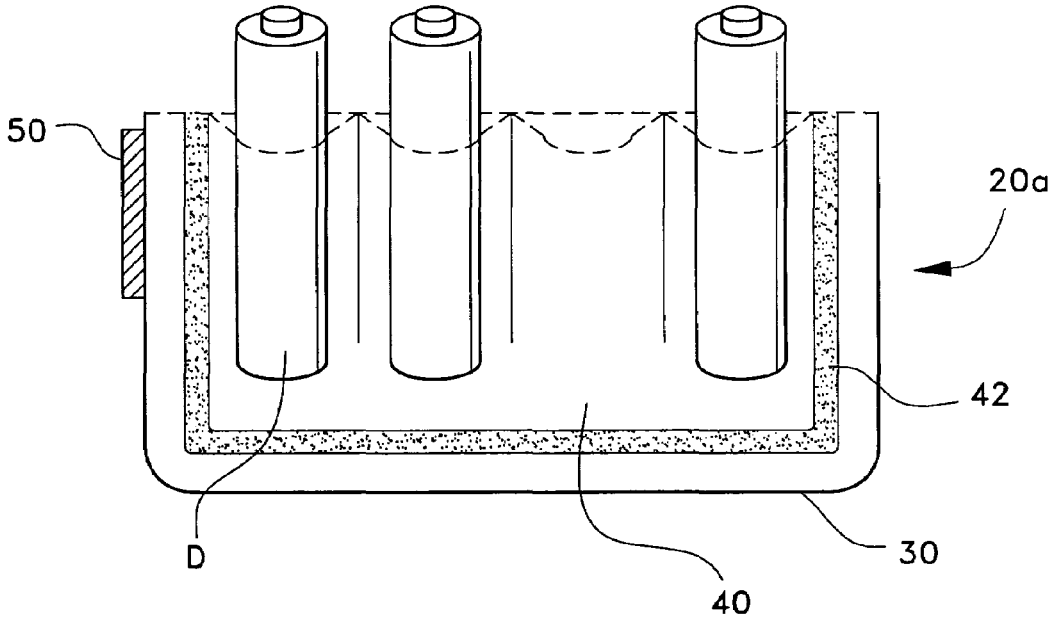
FIG. 2 is a perspective view of an opened battery package as shown and described in present invention.

In the first described embodiment of the packaging 20*a*, as shown in FIGS. 1 and 2, the display card 30 and thermoplastic container 40 have perforations 34*a* running across the package 20*a*. These perforations 34*a* allow the package 20*a* to be torn open in such a manner as to create an open topped container. The adhesive strip 50 is affixed to the back of the display card 30 below the perforations 34*a*, so that when the packaging 20*a* is opened, the open package 20*a* may still be secured to the cabinet door, shed wall, RV wall or any other vertical surface near where batteries may be needed. The individual batteries D may be removed from the open package 20*a* as needed, leaving the unused batteries D in an organized, easily accessible location.

Figure 6:
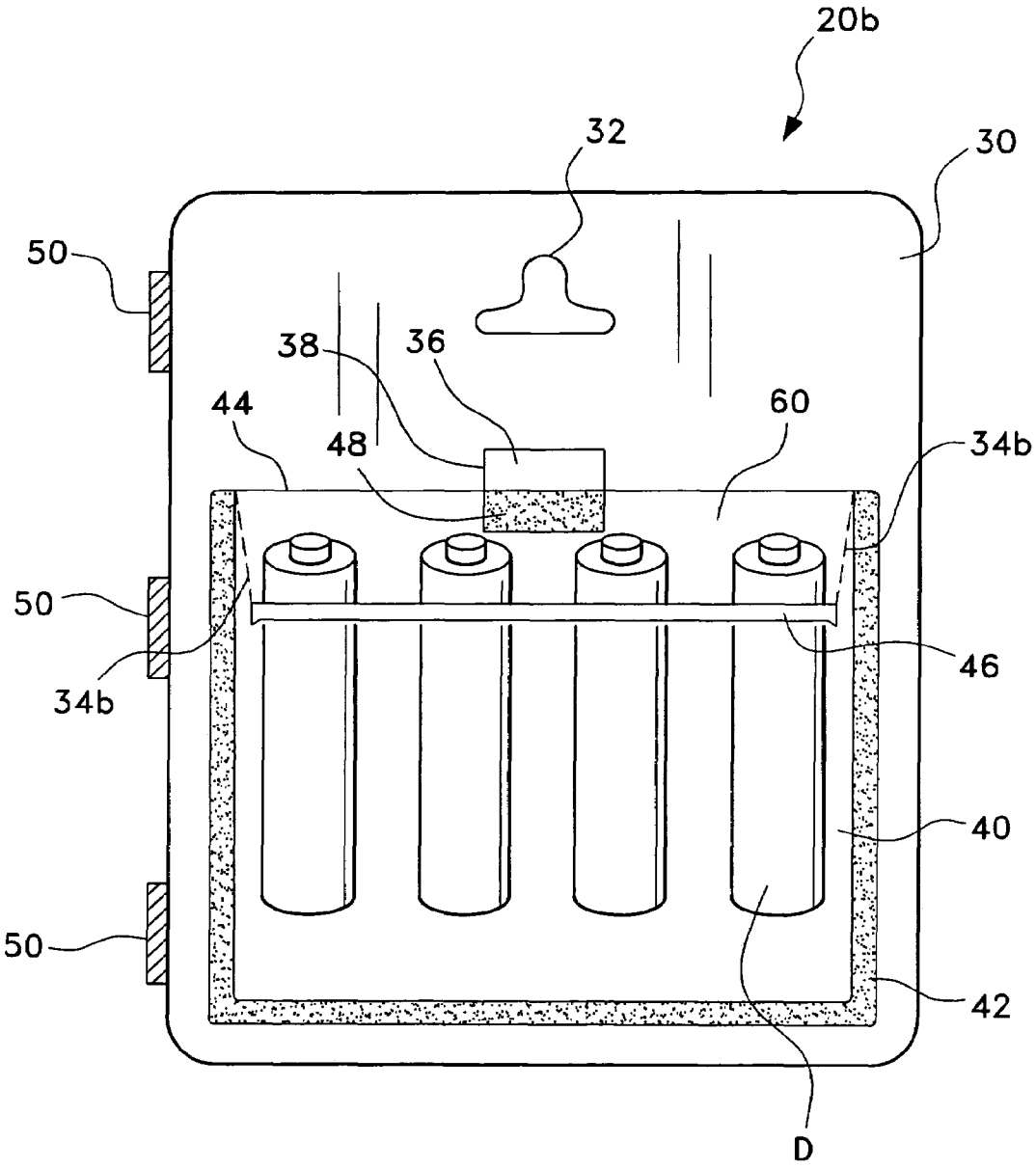
FIG. 6 is a perspective view of a battery package with a front opening flap as shown and described in present invention.
Figure 7:
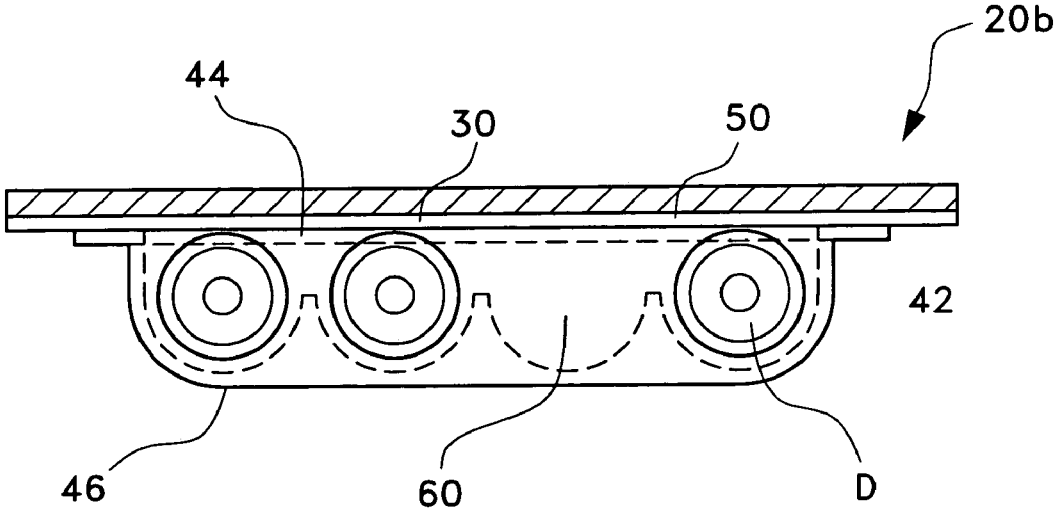
FIG. 7 is a top view of a battery package with a front opening flap as shown and described in present invention.
Figure 8:
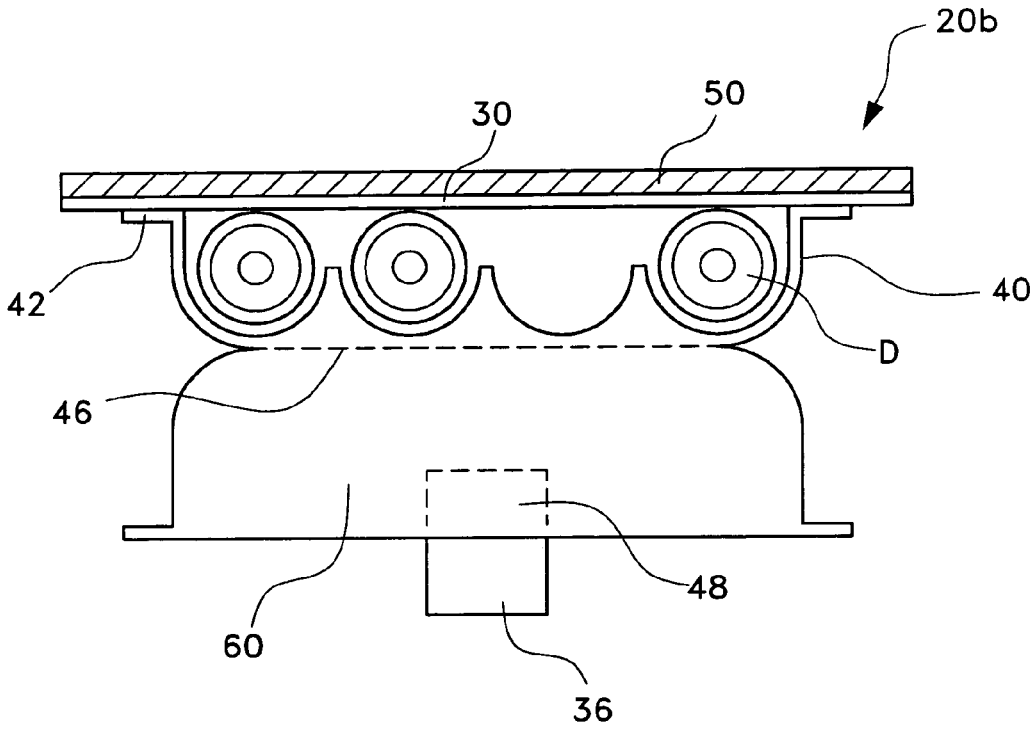
FIG. 8 is a top view of an opened battery package with a front opening flap as shown and described in present invention.

In an alternative embodiment of the packaging 20*b*, as shown in FIGS. 6–8, the perforations 34*b* may only run down from the top edge 44 of the container 40 to a pre-formed crease 46 that runs across the front of the container 40. A small tab 36 is formed in the display card 30 by a series of perforations 38. The tab 36 is secured to the top edge 44 of the container 40 using a heat seal 48. The remainder of the top edge 44 of the container 40 is not sealed to the display card 30. The tab 36 may be torn from the display card 30, and the top section 60 of the thermoplastic container 40 may then be pulled forward, folding over the pre-formed crease 46. This allows the batteries D to be removed from the package 20*b* while retaining the integrity of the remainder of the container 40 so that the container 40 may still be used to store batteries D. The individual batteries D may be removed from the open package 20*b* as needed, leaving the unused batteries D in an organized, easily accessible location.

Figure 9:
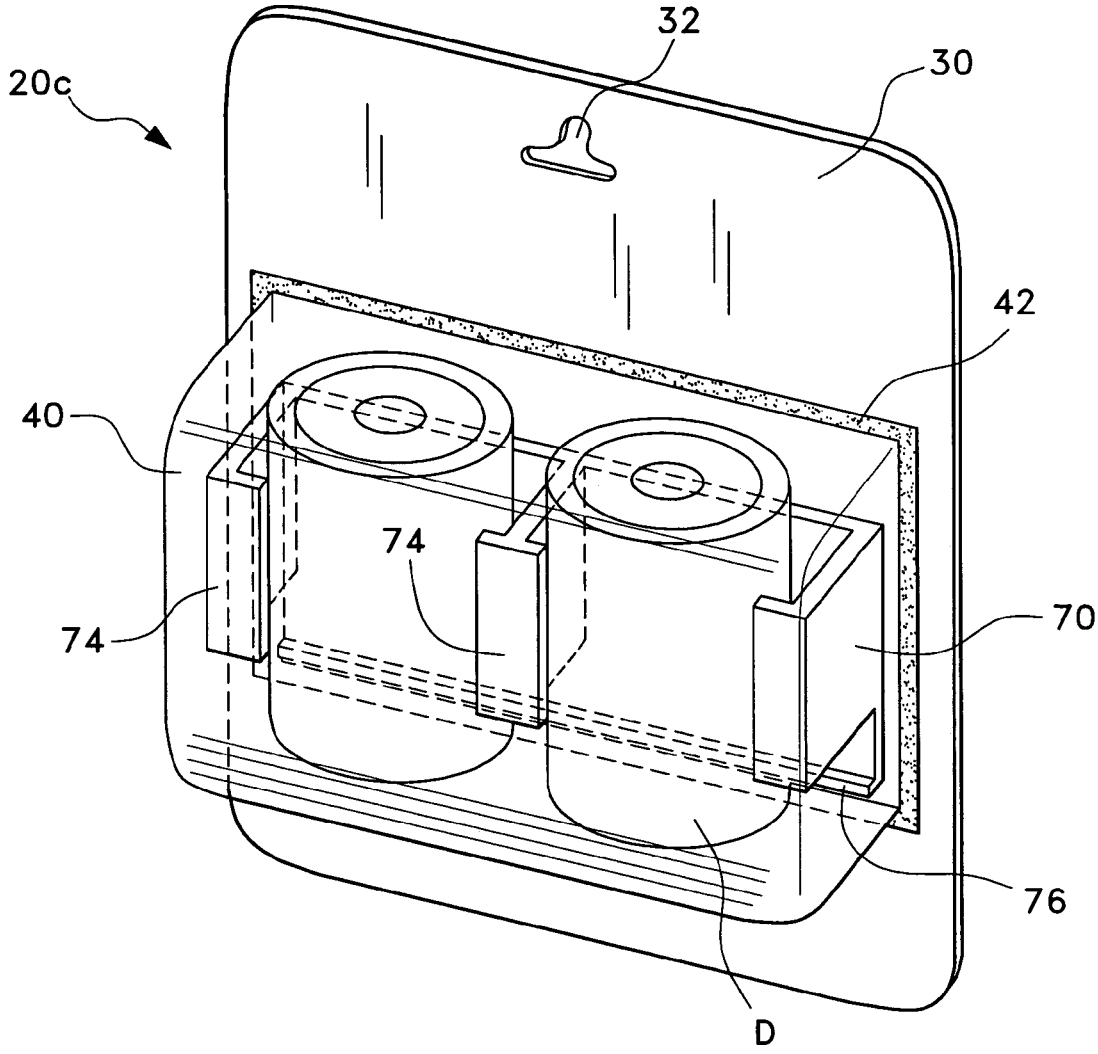
FIG. 9 is a perspective view of a battery package with a clip as shown and described in present invention.
Figure 10:
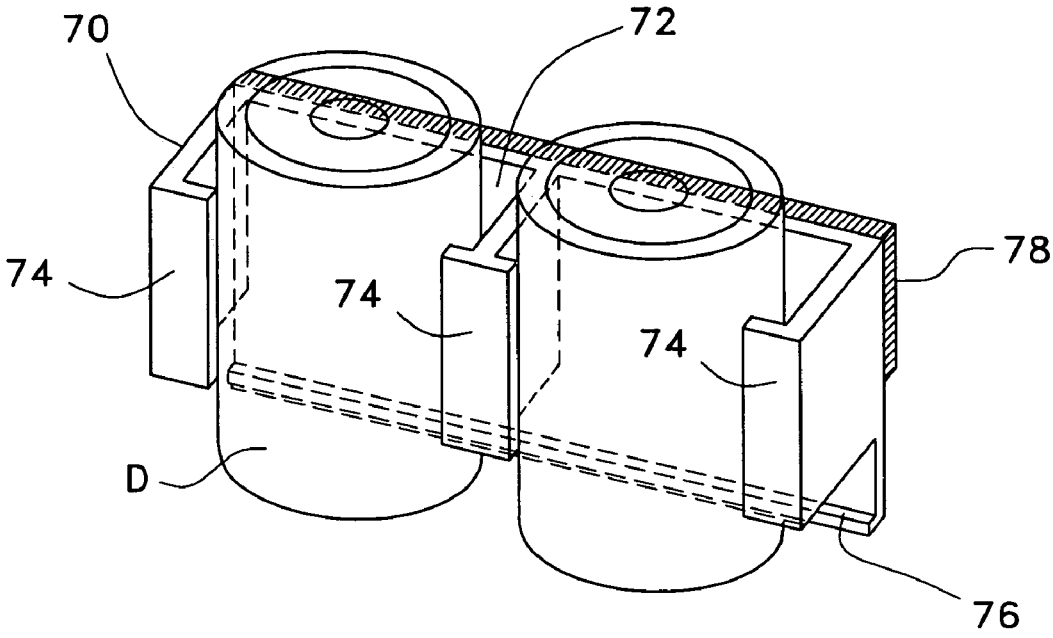
FIG. 10 is a perspective view of a battery and a clip as shown and described in present invention.
Figure 11:
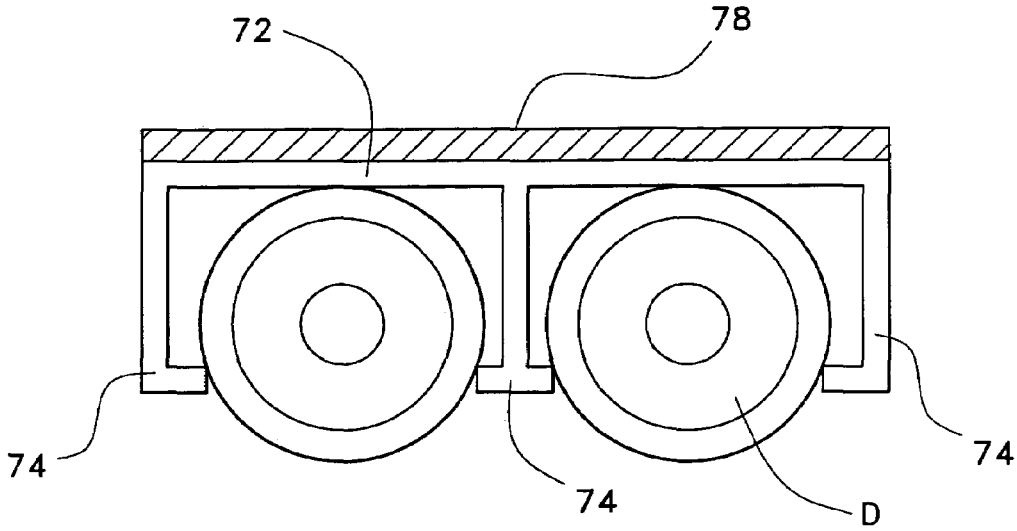
FIG. 11 is a top view of batteries and a clip as shown and described in present invention.

In a third embodiment of the packaging 20*c*, as shown in FIGS. 9–11, a clip 70 with a base 72 and a number of gripping arms 74 holds each of the individual batteries D and is held within the thermoplastic container 40. The clip 70 has a small ledge 76 on the bottom of its base 72 that helps to support the batteries D as they are held between the gripping arms 74. The clip 70 also has an adhesive strip 78 affixed to the back of the base 72. When the packaging 20*c* is opened and the clip 70 is removed, the clip 70 may be secured to a vertical surface, with the unused batteries D still held within the gripping arms 74 of the clip 70. Again, the individual batteries D may be removed from the clip 70 as needed, leaving the unused batteries D in an organized, easily accessible location.

Figure 12:
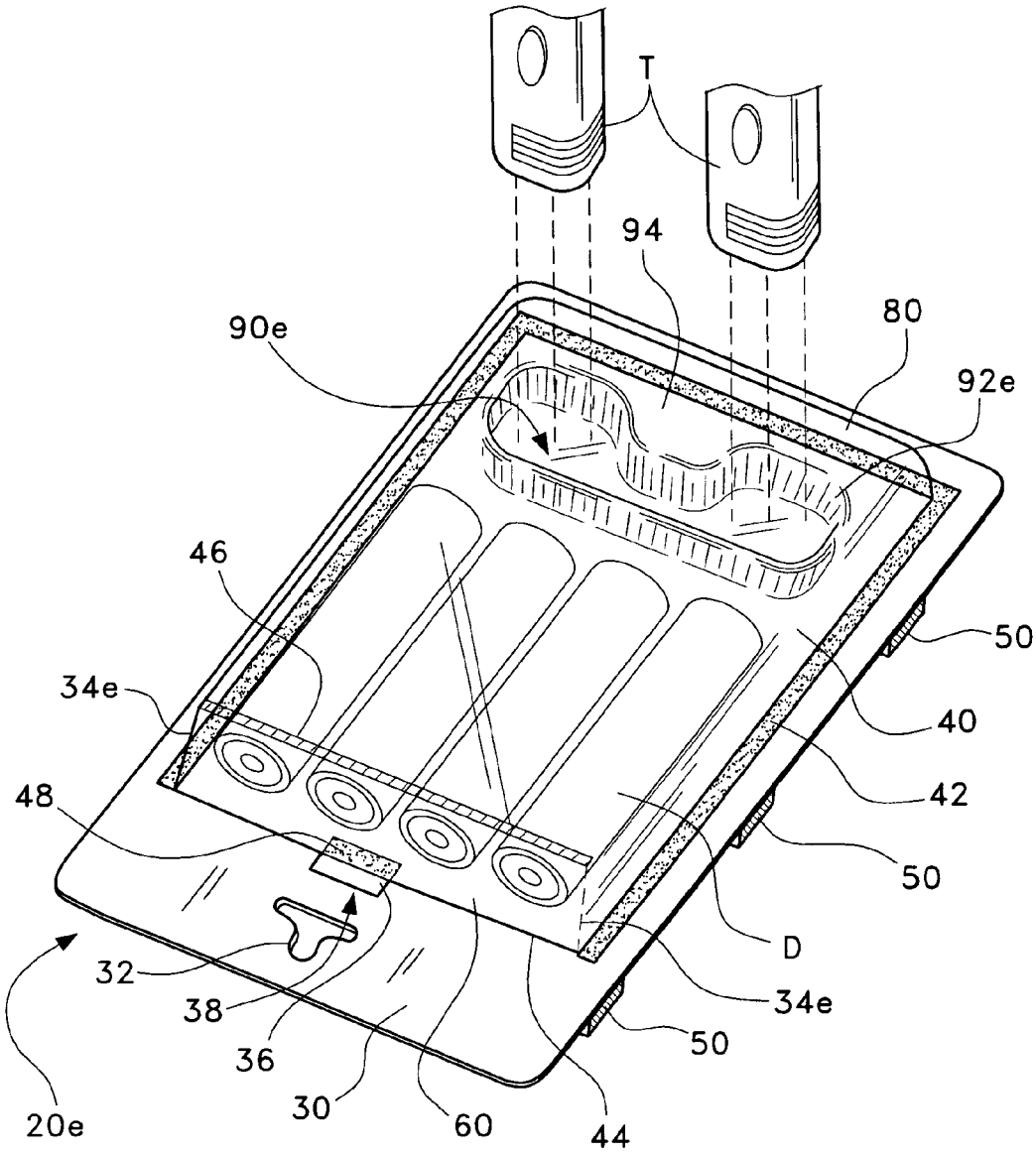
FIG. 12 is an environmental, perspective view of a battery package with a front opening flap and a reservoir as shown and described in present invention.
Figure 13:
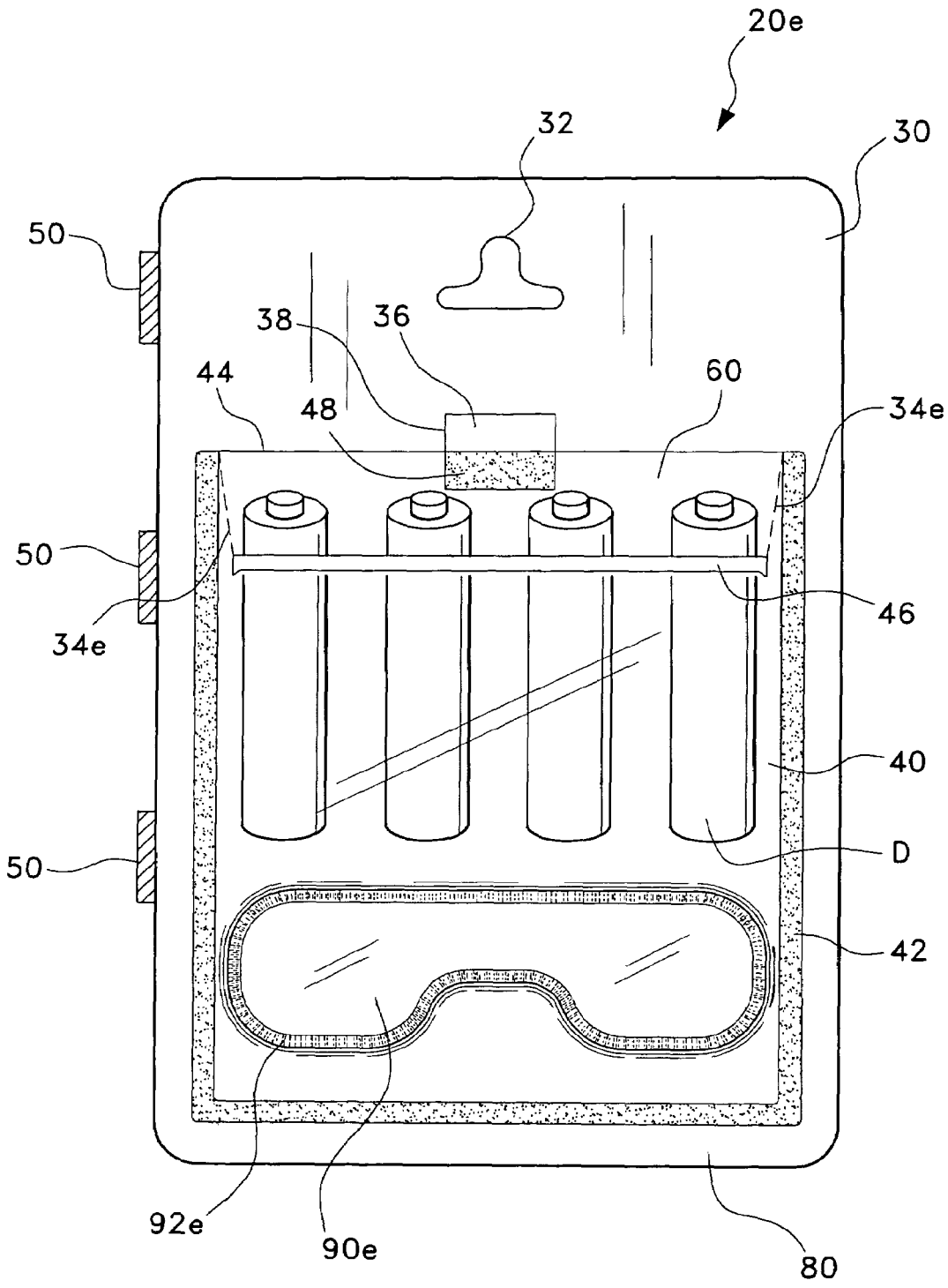
FIG. 13 is a top view of a battery package with a front opening flap and a reservoir as shown and described in present invention.

In a fourth embodiment of the packaging 20*e*, as shown in FIGS. 12 and 13, the packaging 20*e* may be extended at the lower end 80 to allow a reservoir 90*e* to be formed into the thermoplastic container 40. The reservoir 90*e* is defined by a recess 92*e* formed in the top surface 94 of the battery-accommodating portion of the thermoplastic container 40. The reservoir 90*e* is adapted to receive the base end T of at least one electric toothbrush, in order to store the toothbrush near the batteries D. Any water and toothpaste residue that may slide off of the toothbrush T will be collected in the reservoir 90*e*.

Figure 14:
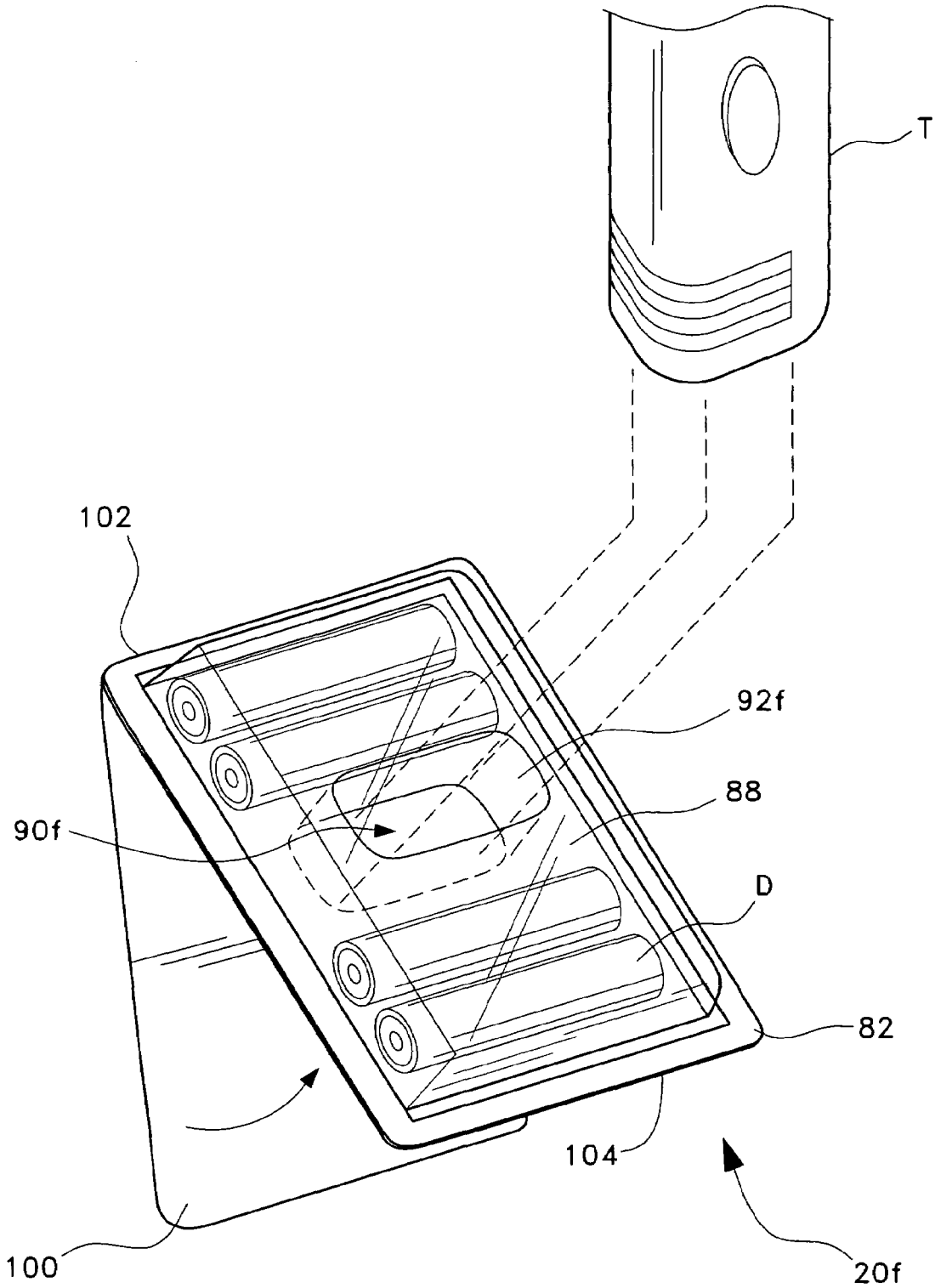
FIG. 14 is an environmental, perspective view of a battery package with a clam shell design and a reservoir as shown and described in present invention.
Figure 15:
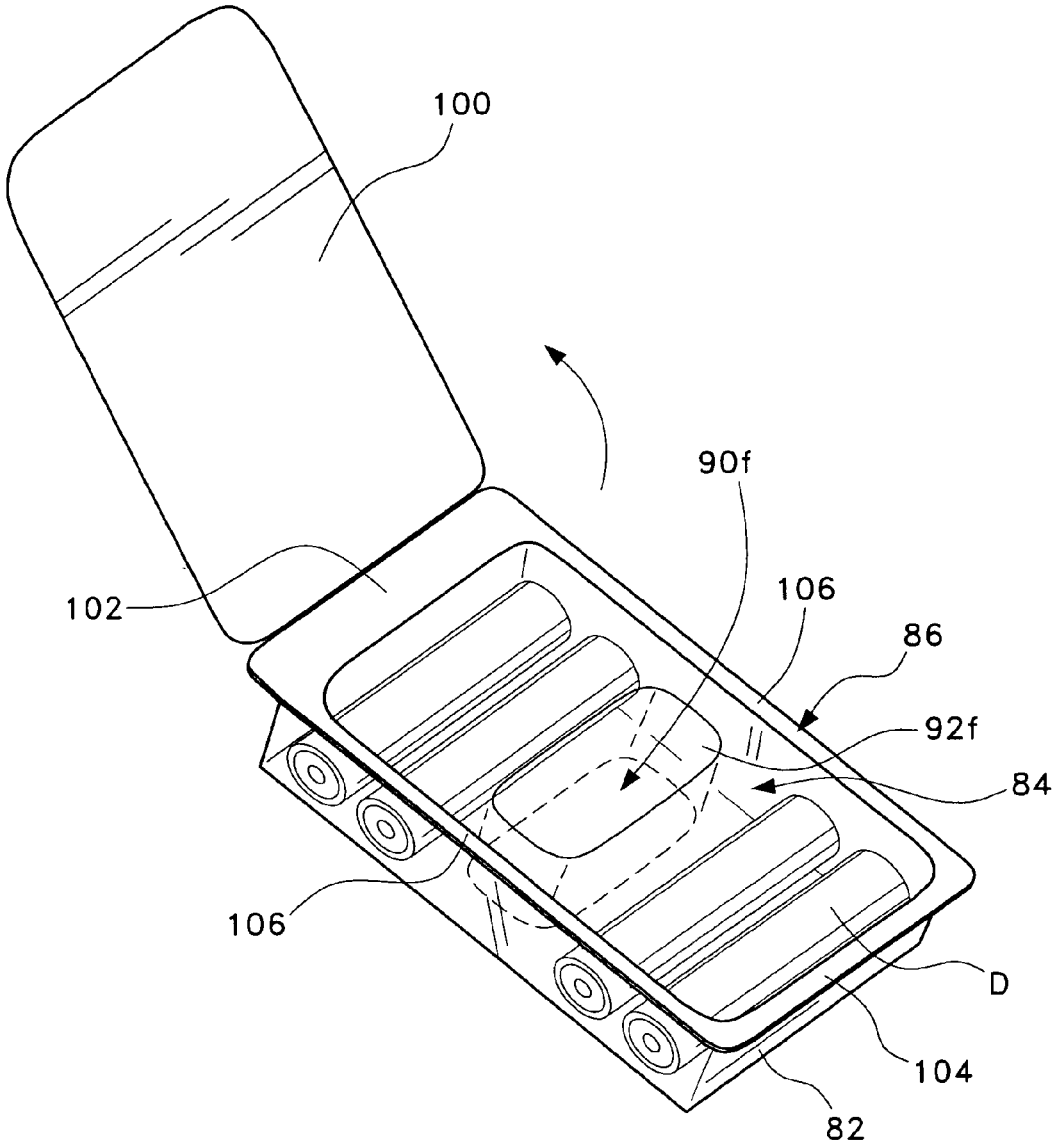
FIG. 15 is a top, perspective view of a battery package with a clam shell design and a reservoir as shown and described in present invention.

In a fifth embodiment of the packaging 20*f*, as shown in FIG. 14, the battery packaging 20*f* may use a standard clam shell design with a reservoir 90*f* formed in the battery accommodating portion 82 of the clam shell packaging 20*f*. The clam shell packaging 20*f* includes at least one battery-accommodating portion 82 and an opening 84 in the battery-accommodating portion 82 for allowing the user to access the batteries D. As shown in FIG. 15, a sealing edge 86 surrounds the opening 84 on the battery-accommodating portion 82, the sealing edge 86 having a top end 102, a bottom end 104, and two sides 106. A lid 100 is pivotally connected to the top end 102 of the sealing edge 86. The lid 100 may mateably engage the sealing edge 86 to close the opening 84 in the battery-accommodating portion 82 of the packaging 20*f*. The lid 100 may also be pivoted open to allow the user to access the batteries D through the opening 84.

The reservoir 90*f* in the clam shell packaging 20*f* is defined by a recess 92*f* formed in the top surface 88 of the battery accommodating portion 82. The reservoir 90*f* is adapted to receive the base end T of at least one electric toothbrush, in order to store the toothbrush near the batteries D. Any water and toothpaste residue that may slide off of the toothbrush T will be collected in the reservoir 90*f*.

It is to be understood that the present invention is not limited to the embodiments described above, but encompasses any and all embodiments within the scope of the following claims.

I claim:

1. A storage and display package for batteries comprising:

a display card;

a container secured to said display card, the container having a bottom surface forming at least one battery accommodating portion and a top surface having a recess formed therein defining a reservoir adapted for receiving a base end of a toothbrush;

perforations formed in said display card defining a removable tab section of said display card, such that the tab is secured to a top edge of said container;

a crease formed into the front of said container; and at least one set of perforations passing through said container from the top edge of said container to said crease, said perforations with said crease defining a top section of said container, such that when the removable tab section of said display card is pulled forward, the top section folds over said crease to allow access to the contents of said container.

2. The storage and display package for batteries according to claim 1, further comprising at least one hole formed through said display card, such that said package may be hung on a hook or peg.

* * * * *